US010763597B2

(12) United States Patent
Iwata

(10) Patent No.: US 10,763,597 B2
(45) Date of Patent: Sep. 1, 2020

(54) CRIMP TERMINAL HAVING A GROOVE FOR FACILITATING CRIMPING WORKABILITY AND A WATER STOP MEMBER

(71) Applicant: Yazaki Corporation, Tokyo (JP)

(72) Inventor: Masashi Iwata, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/978,360

(22) Filed: May 14, 2018

(65) Prior Publication Data

US 2018/0261931 A1 Sep. 13, 2018

Related U.S. Application Data

(63) Continuation of application No. PCT/JP2016/086252, filed on Dec. 6, 2016.

(30) Foreign Application Priority Data

Dec. 16, 2015 (JP) ..... 2015-244883

(51) Int. Cl.
*H01R 4/18* (2006.01)
*H01R 4/70* (2006.01)
(Continued)

(52) U.S. Cl.
CPC ..... *H01R 4/184* (2013.01); *H01R 4/62* (2013.01); *H01R 4/70* (2013.01); *H01R 13/52* (2013.01); *H01R 43/005* (2013.01); *H01R 43/048* (2013.01)

(58) Field of Classification Search
CPC ..... H01R 4/184; H01R 4/62; H01R 43/005; H01R 43/048; H01R 13/52
(Continued)

(56) References Cited

U.S. PATENT DOCUMENTS 2,939,905 A * 6/1960 Canfield ..... H01B 7/04 174/113 C
5,484,961 A * 1/1996 Itoh ..... H01R 4/185 174/84 C
(Continued)

FOREIGN PATENT DOCUMENTS

CN 105051983 A 11/2015
DE 102 53 977 A1 12/2003
(Continued)

OTHER PUBLICATIONS

Notification of Reasons for Refusal for JP 2015-244883 dated Dec. 13, 2017.
(Continued)

*Primary Examiner* — Travis S Chambers
(74) *Attorney, Agent, or Firm* — Sughrue Mion, PLLC

(57) ABSTRACT

A crimp terminal includes a terminal connection portion electrically connected to a counterpart terminal; and a plate-shaped electric wire connection portion electrically connected to an end portion of an electric wire placed on an inner wall surface side by a crimping process during which the electric wire connection portion is sandwiched between a first die and a second die. The electric wire connection portion includes a bottom on which the end portion of the electric wire is placed in the crimping process, and first and second barrel pieces that are extended from both ends of the bottom and are rolled to a region from a tip core to a coating at an end portion of the electric wire by the crimping process.

3 Claims, 12 Drawing Sheets

(51) Int. Cl.

| | |
|---|---|
| *H01R 4/62* | (2006.01) |
| *H01R 13/52* | (2006.01) |
| *H01R 43/00* | (2006.01) |
| *H01R 43/048* | (2006.01) |

(58) Field of Classification Search
USPC ..... 439/877, 878
See application file for complete search history.

(56) References Cited

U.S. PATENT DOCUMENTS

| | | | | |
|---|---|---|---|---|
| 9,147,944 | B2 * | 9/2015 | Aizawa | H01R 4/185 |
| 9,391,384 | B2 * | 7/2016 | Kodama | H01R 4/62 |
| 9,640,877 | B2 * | 5/2017 | Aoki | H01R 4/185 |
| 9,711,872 | B2 * | 7/2017 | Sato | H01R 4/185 |
| 9,755,327 | B2 * | 9/2017 | Aoki | H01R 4/185 |
| 9,774,099 | B2 * | 9/2017 | Aoki | H01R 4/62 |
| 9,847,596 | B2 * | 12/2017 | Sato | H01R 4/185 |
| 2001/0016460 | A1 * | 8/2001 | Koide | H01R 4/184 439/877 |
| 2013/0095708 | A1 * | 4/2013 | Mitose | H01R 4/184 439/878 |
| 2015/0244084 | A1 | 8/2015 | Aizawa et al. | |
| 2016/0006136 | A1 | 1/2016 | Matsumura et al. | |
| 2016/0006164 | A1 * | 1/2016 | Sato | H01R 4/185 439/587 |
| 2016/0352033 | A1 * | 12/2016 | Sachs | H01R 4/188 |

FOREIGN PATENT DOCUMENTS

| | | | |
|---|---|---|---|
| JP | 6-260258 | A | 9/1994 |
| JP | 2001-217013 | A | 8/2001 |
| JP | 2009-135022 | A | 6/2009 |
| JP | 2009-152054 | A | 7/2009 |
| JP | 2010-244889 | A | 10/2010 |
| JP | 2013-149564 | A | 8/2013 |
| JP | 2014-182953 | A | 9/2014 |
| JP | 2014-182957 | A | 9/2014 |
| JP | 2015-201269 | A | 11/2015 |
| WO | 2011/122622 | A1 | 10/2011 |

OTHER PUBLICATIONS

Notification of Reasons for Refusal for JP 2015-244883 dated Mar. 29, 2018.
International Search Report for PCT/JP2016/086252 dated Feb. 21, 2017.
Communication dated Feb. 2, 2019 from the State Intellectual Property Office of the P.R.C. in counterpart Application No. 201680066790.0.

* cited by examiner

CRIMP TERMINAL HAVING A GROOVE FOR FACILITATING CRIMPING WORKABILITY AND A WATER STOP MEMBER

CROSS-REFERENCE TO RELATED APPLICATION(S)

This application is a continuation application of International Application PCT/JP2016/086252, filed on Dec. 6, 2016, and designating the U.S., the entire contents of which are incorporated herein by reference.

BACKGROUND OF THE INVENTION

1. Field of the Invention

The present invention relates to a crimp terminal.

2. Description of the Related Art

Conventionally, crimp terminals including an electric wire connection portion to be electrically connected to a core of an electric wire have been known. The crimp terminal is formed by subjecting a metal plate serving as base material to punching, bending, and the like. The electric wire connection portion is a U-shaped portion formed from a bottom and two opposed barrel pieces, and in a crimping process, the bottom and free ends of the barrel pieces are sandwiched by two dice, an interval between the dice is decreased, and each of the barrel pieces is bent toward the other barrel piece to roll the electric wire. Crimp terminals of this type are disclosed in Japanese Patent Application Laid-open No. 2014-182953, Japanese Patent Application Laid-open No. 2014-182957 and Japanese Patent Application Laid-open No. 2001-217013, for example.

The rigidity of a crimp terminal is increased depending on the plate thickness of a metal plate serving as base material. For example, when a crimp terminal is applied to an electric wire having a large wire diameter, the plate thickness of the base material is increased to enhance the rigidity of the entire crimp terminal in order to bear the weight of the electric wire, or the length of a barrel piece is increased in order to secure the amount of rolling around the electric wire to enhance the rigidity of an electric wire connection portion as a result. Thus, although the barrel piece in the electric wire connection portion is bent following the shape of a die on the free end side during a crimping process in general, the barrel piece is not bent following the shape of the die due to its rigidity, and there is a possibility that a desired crimping form for the electric wire cannot be achieved. Note that Patent Literature 3 above discloses a technology in which a barrel piece for rolling a tip core at an end portion of an electric wire and a barrel piece for rolling a coating at the end portion of the electric wire are individually provided, and a groove for facilitating bending during a crimping process is provided in the barrel piece for the coating.

SUMMARY OF THE INVENTION

It is therefore an object of the present invention to provide a crimp terminal having excellent crimping workability.

A crimp terminal according to one aspect of the present invention includes a terminal connection portion electrically connected to a counterpart terminal; and a plate-shaped electric wire connection portion electrically connected to an end portion of an electric wire placed on an inner wall surface side by a crimping process during which the electric wire connection portion is sandwiched between a first die and a second die, wherein the electric wire connection portion includes a bottom on which the end portion of the electric wire is placed in the crimping process, and first and second barrel pieces that are extended from both ends of the bottom, respectively, and are rolled to a region from a tip core to a coating at an end portion of the electric wire by the crimping process, at least one of the first barrel piece and the second barrel piece has at least one straight groove portion which serves as a starting point of bending for the crimping process and which is formed along an axial direction of the end portion of the electric wire and over the region from the tip core to the coating at the end portion of the electric wire, and the groove portion is a low-rigidity site which is interposed between a high-rigidity site on the electric wire side and a high-rigidity site on the distal end side in the extending direction and has rigidity lower than rigidity of the high rigidity sites.

According to another aspect of the present invention, in the crimp terminal, it is preferable that the groove portion is provided closer to a distal end in the extending direction than the end portion of the electric wire placed on the bottom.

According to still another aspect of the present invention, in the crimp terminal, it is preferable that when the second barrel piece is extended longer than the first barrel piece, the groove portion is provided at the second barrel piece.

According to still another aspect of the present invention, it is preferable that the crimp terminal further includes a water stop member that is overlaid on and attached to at least the groove portion in the inner wall surface of the electric wire connection portion before the crimping process is performed, and is filled in the groove portion by the crimping process and left therein, so as to suppress entry of water into the electric wire connection portion after the crimping process is completed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A crimp terminal according to an embodiment of the present invention is described in detail below with reference to the drawings. The present invention is not limited by the embodiment.

Embodiment

A crimp terminal according to one embodiment of the present invention is described with reference to FIG. 1 to FIG. 14.

Figure 1:
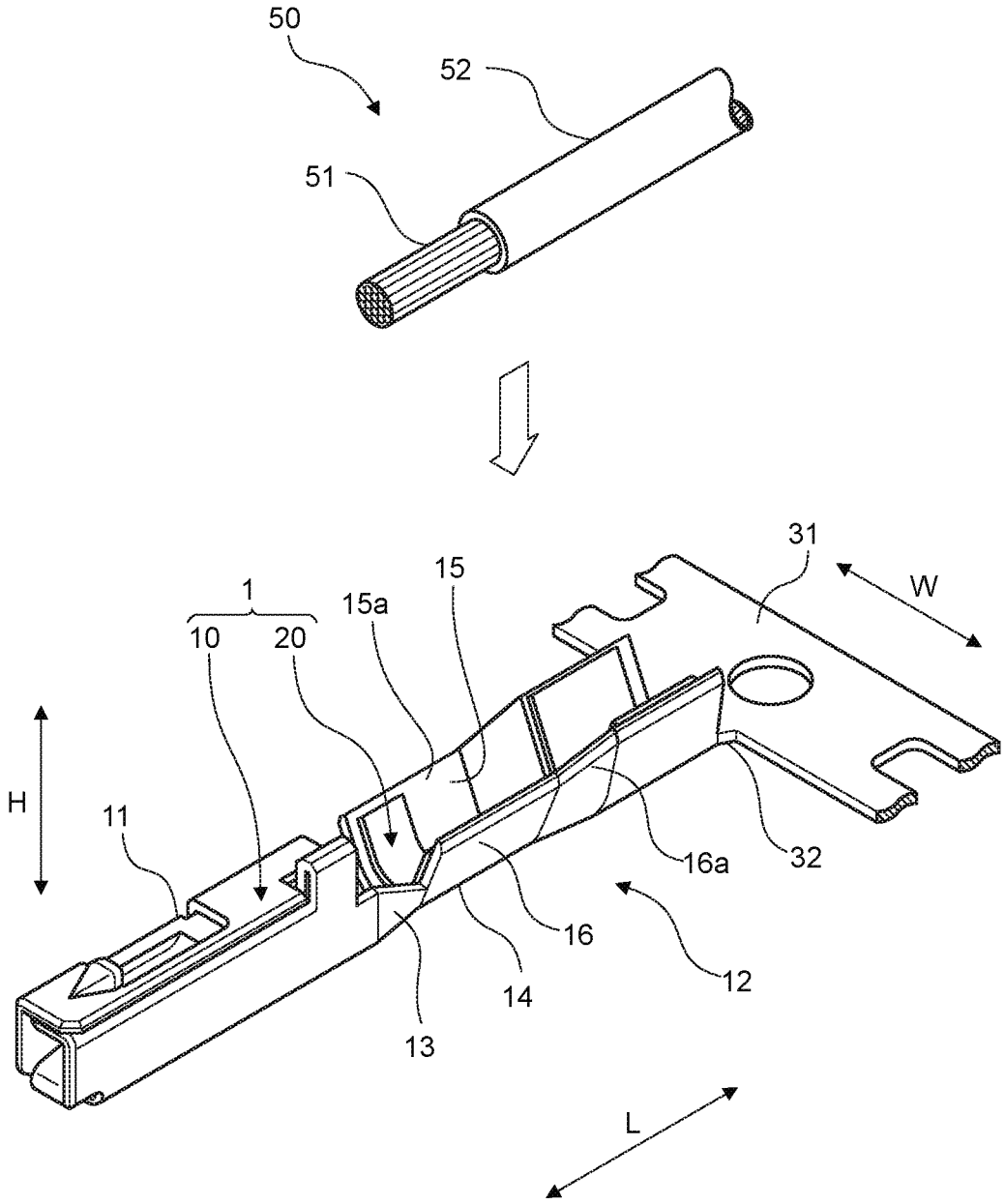
FIG. 1 is a perspective view illustrating a crimp terminal according to an embodiment, and illustrates a state before being connected to an electric wire.
Figure 2:
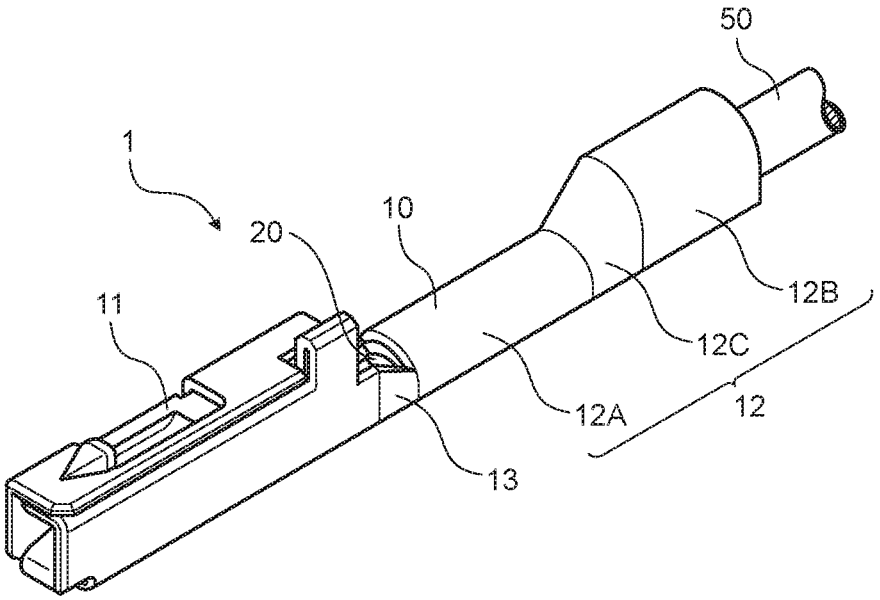
FIG. 2 is a perspective view illustrating the crimp terminal after completion of crimping according to the embodiment.
Figure 3:
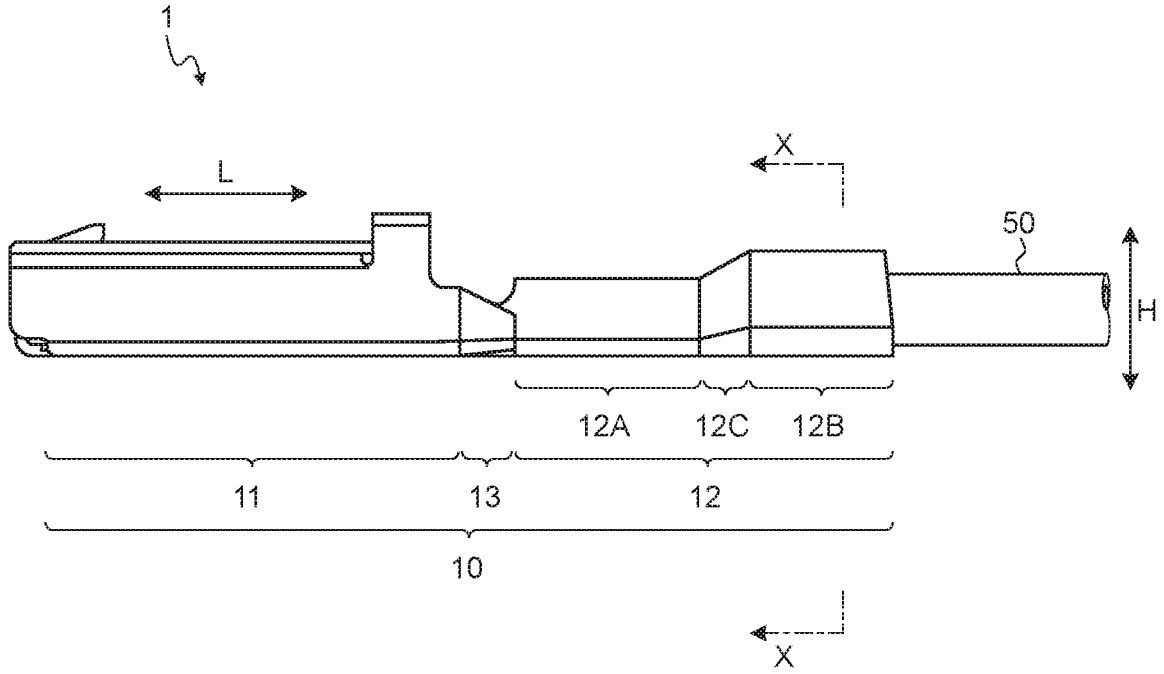
FIG. 3 is a side view illustrating the crimp terminal after the completion of crimping according to the embodiment.

Reference numeral 1 in FIG. 1 to FIG. 3 represents a crimp terminal in the present embodiment. The crimp terminal 1 is electrically connected to an electric wire 50, and is electrically connected to a counterpart terminal (not shown) while being integrated with the electric wire 50. In this case, in order to expose a predetermined length of a core 51 at an end portion of the electric wire 50, a coating 52 is peeled off and removed by the length. The core 51 may be either an assembly of wires or a single wire like a coaxial cable. The crimp terminal 1 is crimped to the end portion of the electric wire 50 in order to be electrically connected to the electric wire 50, thereby being electrically connected to the exposed tip core (hereinafter referred to simply as "tip core") 51.

The crimp terminal 1 in the present embodiment is exemplified as a crimp terminal including a terminal fitting 10 and a water stop member 20 in order to secure waterproof property. Note that the crimp terminal 1 may be formed only of the terminal fitting 10.

Figure 4:
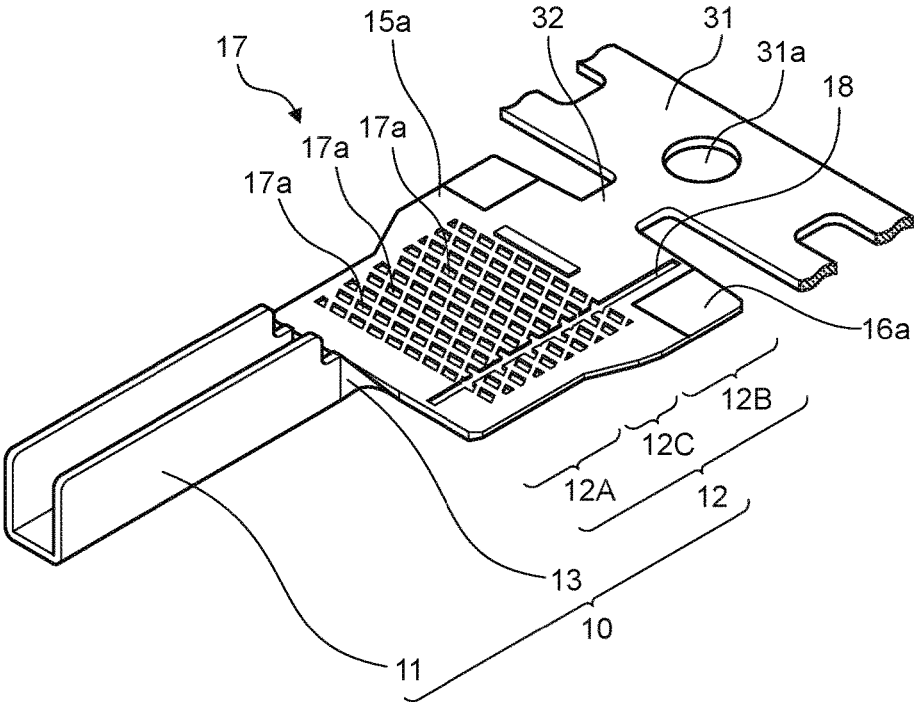
FIG. 4 is a perspective view illustrating a terminal fitting for the crimp terminal according to the embodiment, and illustrates a state before a water stop member is attached.
Figure 5:
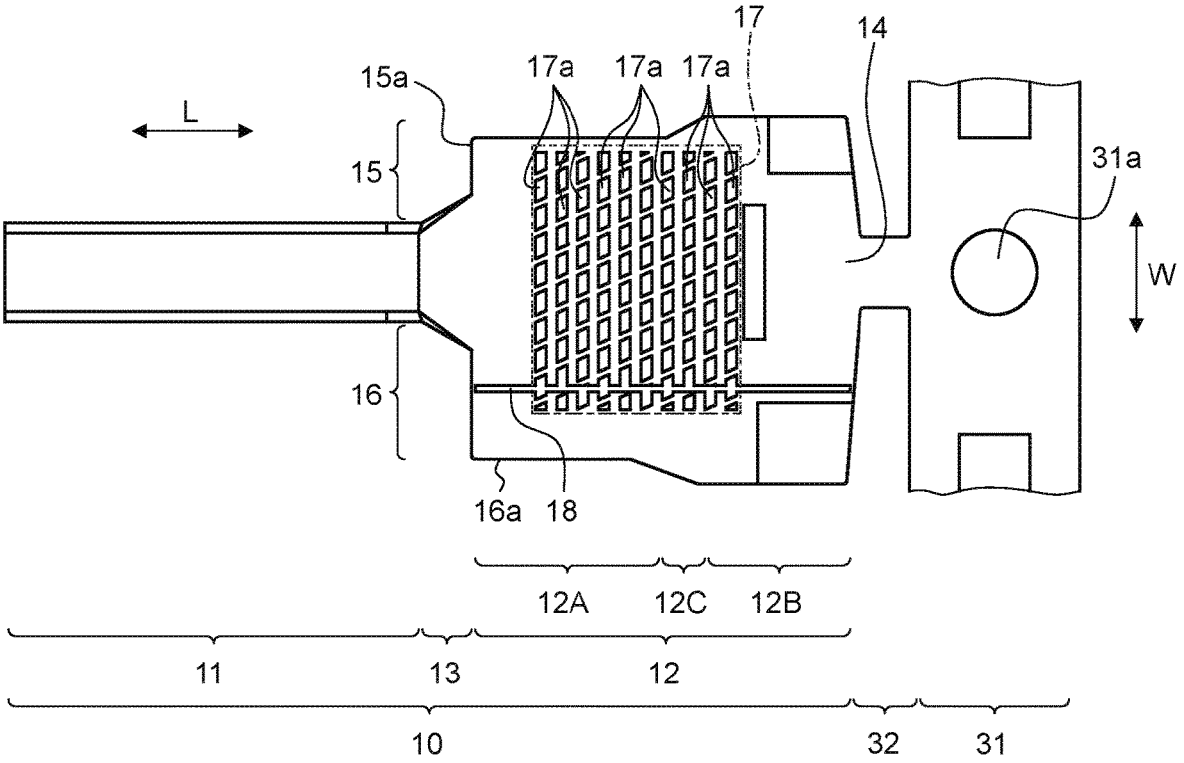
FIG. 5 is a top view illustrating the terminal fitting for the crimp terminal according to the embodiment, and illustrates a state before the water stop member is attached.

The terminal fitting 10 is a principal part of the exemplified crimp terminal 1. The terminal fitting 10 is obtained by subjecting a conductive metal plate (for example, a copper plate) serving as base material to punching, bending, and the like and by forming the resultant to have a predetermined shape allowing connection to a counterpart terminal or the electric wire 50. As illustrated in FIG. 4, FIG. 5, and others, the terminal fitting 10 has a terminal connection portion 11 to be electrically connected to a counterpart terminal and an electric wire connection portion 12 to be electrically connected to the electric wire 50. The terminal connection portion 11 and the electric wire connection portion 12 are coupled to each other with a coupling portion 13 interposed therebetween.

The terminal fitting 10 may be either a male terminal or a female terminal. The terminal connection portion 11 is formed as a male type when the terminal fitting 10 is a male terminal, and is formed as a female type when the terminal fitting 10 is a female terminal. In the present embodiment, the terminal fitting 10 is exemplified as a female terminal.

In this case, in the crimp terminal 1, the direction of connection (direction of insertion) to a counterpart terminal is defined as a first direction L as a longitudinal direction. Furthermore, a parallel arrangement direction described later of the crimp terminals 1 is defined as a second direction W as a width direction of the crimp terminal 1. Furthermore, in the crimp terminal 1, a direction orthogonal to each of the first direction L and the second direction W is defined as a third direction H as a height direction.

The electric wire connection portion 12 is first formed into a single plate (FIG. 4 and FIG. 5), and is formed into a U shape as the state immediately before being connected to the electric wire 50 (FIG. 1). Then, the electric wire connection portion 12 is wound around the electric wire 50 in the state in which the end portion of the electric wire 50 is placed on the electric wire connection portion 12. In this manner, the electric wire connection portion 12 is crimped to the end portion of the electric wire 50 and brought into contact with the tip core 51.

The electric wire connection portion 12 can be sectioned into a region of a bottom 14, a region of a first barrel piece 15, and a region of a second barrel piece 16 (FIG. 1 and FIG. 5). The bottom 14 is a site serving as a bottom wall of the U-shaped electric wire connection portion 12, and the end portion of the electric wire 50 is placed on the bottom 14 during a crimping process. The first and second barrel pieces 15 and 16 are sites serving as side walls of the U-shaped electric wire connection portion 12, and are extended at both ends of the bottom 14 in the second direction W, respectively. In the U-shaped electric wire connection portion 12, the first and second barrel pieces 15 and 16 extend from both ends of the bottom 14 so as to surround the end portion of the electric wire 50.

Figure 6:
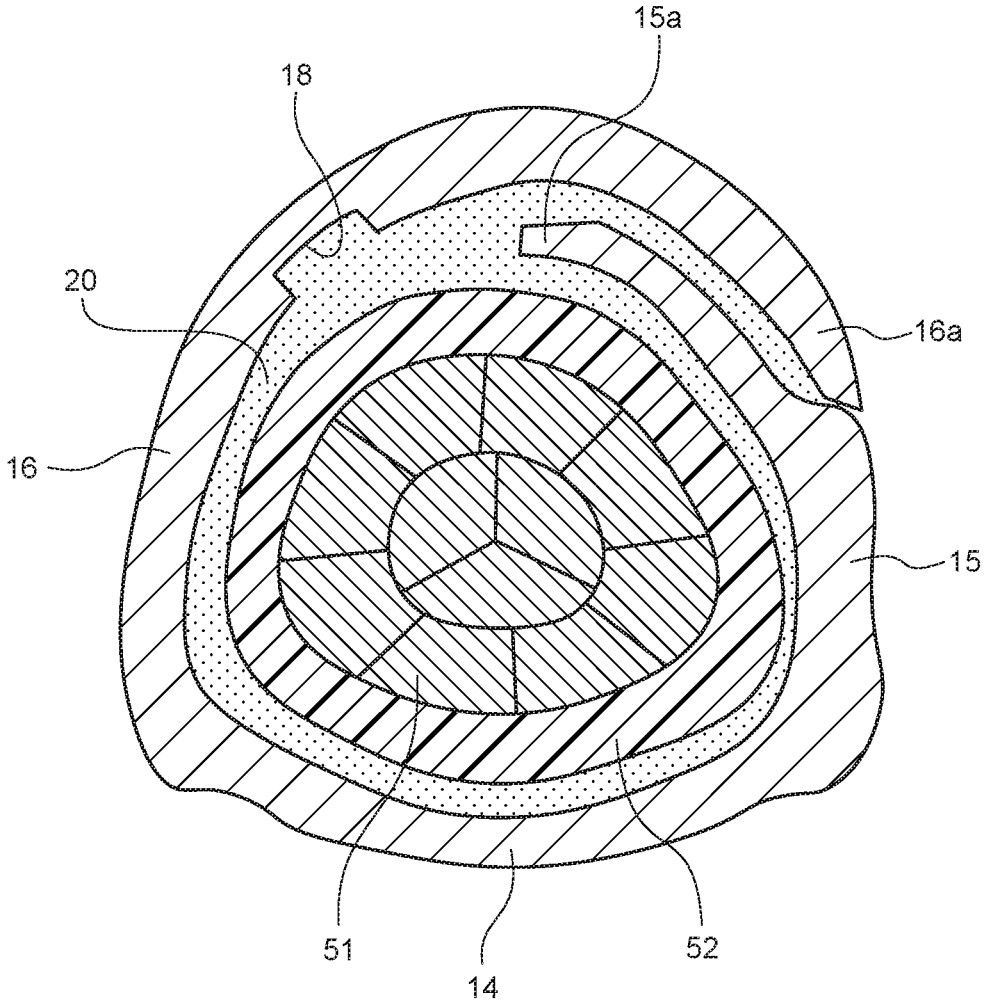
FIG. 6 is a diagram illustrating a cross-sectional part of an electric wire connection portion cut along the line X-X in FIG. 3.

The lengths of the first barrel piece 15 and the second barrel piece 16 refer to distances from the root on the bottom 14 side to end surfaces of distal ends (end portions on free end side) 15*a* and 16*a*, respectively. The first barrel piece 15 and the second barrel piece 16 may be formed such that the lengths thereof are equal to each other, or may be formed such that one of the first barrel piece 15 and the second barrel piece 16 may be longer than the other barrel piece. The present embodiment employs the latter case. Thus, one of the respective distal ends 15*a* and 16*a* protrudes in the third direction H more than the other distal end in the U-shaped electric wire connection portion 12. In the present exemplification, the second barrel piece 16 is extended from the bottom 14 to be longer than the first barrel piece 15. Thus, in the electric wire connection portion 12, a region in which the first barrel piece 15 and the second barrel piece 16 overlap with each other (hereinafter referred to as "overlap region") is formed after the crimping process is completed (hereinafter referred to as "after the completion of the crimping process") is formed (FIG. 6). Specifically, the overlap region is a region in which an outer wall surface of the first barrel piece 15 and an inner wall surface of the second barrel piece 16 are opposed to each other after the completion of the crimping process. In other words, in the electric wire connection portion 12, the first barrel piece 15 is a barrel piece to be wound around the end portion of the electric wire 50 on the inner side, and the second barrel piece 16 is a barrel piece to be wound around the end portion of the electric wire 50 on the outer side. Therefore, in the crimping process, the first barrel piece 15 is wound around an outer circumferential surface of the end portion of the electric wire 50, and the second barrel piece 16 is wound so as to cover the end portion of the electric wire 50 and the first barrel piece 15 in this state from the outer circumferential surface side. In the electric wire connection portion 12, the first barrel piece 15 and the second barrel piece 16 are swaged to the end portion of the electric wire 50 in this manner.

In this case, the end portion of the electric wire 50 is inserted in a U-shaped inner space from the side of a U-shaped opening (opening formed between end surfaces of the respective distal ends 15*a* and 16*a*) of the electric wire connection portion 12. Thus, the electric wire connection portion 12 is formed such that an interval between the first barrel piece 15 and the second barrel piece 16 increases from the bottom 14 side toward the opening (distal ends 15*a* and 16*a*) in order to allow the end portion of the electric wire 50 to be easily inserted.

Furthermore, the electric wire connection portion 12 can be sectioned into a region of a core crimping portion 12A, a region of a coating crimping portion 12B, and a region of a coupling crimping portion 12C (FIG. 2 to FIG. 5). The core crimping portion 12A is a site to be crimped to the tip core 51, and is continuous to the coupling portion 13. The coating crimping portion 12B is a site to be crimped to the coating 52 continuous to the root at the exposed part of the tip core 51. The coupling crimping portion 12C is a site which couples the core crimping portion 12A and the coating crimping portion 12B together and which is crimped to the end portion of the electric wire 50.

In the electric wire connection portion 12, a core holding region (hereinafter referred to as "serration region") 17 for holding the crimped tip core 51 is provided on an inner wall surface of the electric wire connection portion 12 (wall surface on side to cover electric wire 50) (FIG. 4 and FIG. 5). The serration region 17 is disposed on the inner wall surface of the electric wire connection portion 12 in at least a part to be wound around the tip core 51. The exemplified serration region 17 is formed so as to cover the entire tip core 51. Specifically, the serration region 17 in the present embodiment is formed by arranging recesses, protrusions, or a combination of recesses and protrusions in a rectangular shape, and is used to increase a contact area between the electric wire connection portion 12 and the tip core 51 owing to the recesses or the protrusions to enhance adhesion strength therebetween. In the present exemplification, the rectangular serration region 17 is formed by recesses 17*a*.

Figure 7:
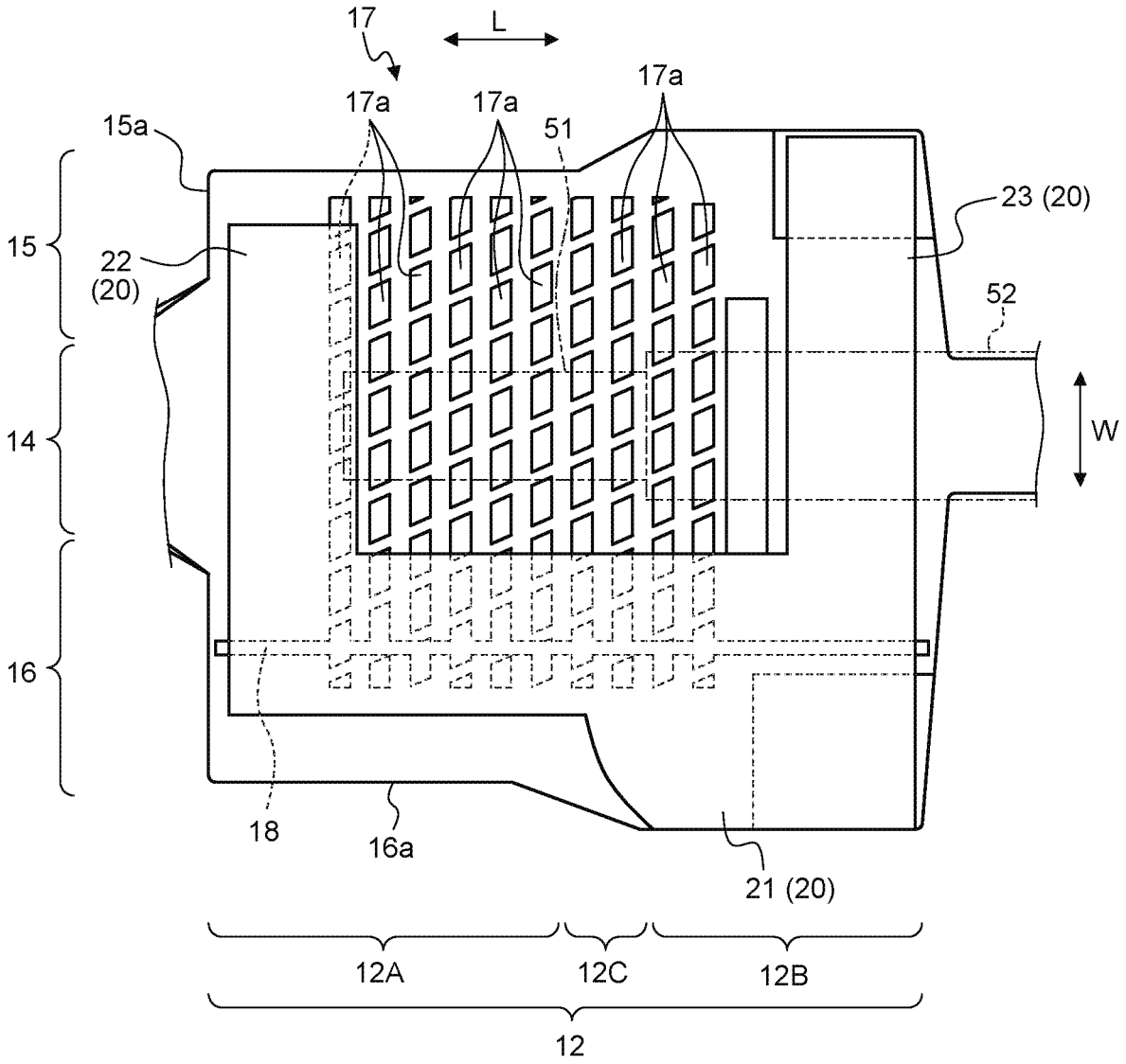
FIG. 7 is a top view illustrating the electric wire connection portion, and illustrates a state after the water stop member is attached.

In this case, the electric wire connection portion 12 and the tip core 51 need to be electrically connected to each other. Thus, the entry of water in the region between the electric wire connection portion 12 and the tip core 51 is not preferable because durability may decrease. For example, in the case where the electric wire connection portion 12 and the core 51 are formed from dissimilar metal materials (such as copper and aluminum) having different ionization tendencies, the aluminum side may corrode due to the entry of water into the region between the electric wire connection portion 12 and the core 51. As a solution, the crimp terminal 1 is provided with the water stop member 20 for suppressing the entry of water into the region between the electric wire connection portion 12 and the tip core 51 (FIG. 7). The water stop member 20 is mainly made of a pressure-sensitive adhesive such as a modified acrylic pressure-sensitive adhesive and formed into a sheet. For example, a member obtained by permeating an adhesive to sheet-shaped non-woven fabric to exhibit pressure-sensitive adhesive effect on both sides of the sheet is used as the water stop member 20.

The water stop member 20 is formed into a predetermined shape, and is then attached to the inner wall surface of the plate-shaped electric wire connection portion 12 illustrated in FIG. 7. The exemplified water stop member 20 has a first water stop portion 21, a second water stop portion 22, and a third water stop portion 23. The first water stop portion 21 is a portion in which a water stop region is formed at least between an outer wall surface of the first barrel piece 15 and an inner wall surface of the second barrel piece 16 (that is, overlap region) after the completion of the crimping process, and suppresses the entry of water into the region between the electric wire connection portion 12 and the tip core 51 from between the outer wall surface of the first barrel piece 15 and the inner wall surface of the second barrel piece 16. The second water stop portion 22 is a portion in which a water stop region is formed at least on the terminal connection portion 11 side with respect to the position of the tip of the tip core 51 located inward of the electric wire connection portion 12 after the completion of the crimping process, and is a region for suppressing the entry of water into the region between the electric wire connection portion 12 and the tip core 51 from the terminal connection portion 11 side. The third water stop portion 23 is a portion in which a water stop region is formed at least between the inner wall surface of the electric wire connection portion 12 (specifically, coating crimping portion 12B) and the coating 52 after the completion of the crimping process, and is a region for suppressing the entry of water into the region between the electric wire connection portion 12 and the tip core 51 from between the inner wall surface of the electric wire connection portion 12 and the coating 52. The water stop member 20 interrupts the communication between the end portion of the electric wire 50 and the outside in the electric wire connection portion 12, and hence can suppress the entry of water into the region between the electric wire connection portion 12 and the tip core 51.

The terminal fitting 10 described above is manufactured in a manner that a single metal plate serving as base material is subjected to a pressing process and processed to have the plate-shaped electric wire connection portion 12 illustrated in FIG. 5, and in a subsequent water stop member attachment process, the water stop member 20 is attached to the plate-shaped electric wire connection portion 12. After that, the terminal fitting 10 is subjected to a bending process such that the terminal connection portion 11 is formed and the U-shaped electric wire connection portion 12 is formed.

The crimp terminals 1 subjected to the above-mentioned processes are formed as a chain body in which the crimp terminals 1 are arranged in plurality (hereinafter referred to as "terminal chain body"). The terminal chain body refers to a collection of the crimp terminals 1 that are arranged in parallel at equal intervals while being oriented to the same direction and are connected in a chain shape. In the terminal chain body, end portions of all the crimp terminals 1 on one side are connected to each other with a coupling piece 31. For example, the coupling piece 31 is formed into a rectangular plate shape and is disposed at a predetermined interval from the electric wire connection portions 12 of all the crimp terminals 1. For example, the bottom 14 of the electric wire connection portion 12 and the coupling piece 31 are connected to each other for each crimp terminal 1 through a rectangular plate-shaped connecting portion 32. In the coupling piece 31, through holes (hereinafter referred to as "terminal feed holes") 31*a* used to feeding the terminal chain body to a crimping position of a terminal crimping device 100 are formed at equal intervals along a feeding direction of the terminal chain body. The thus formed terminal chain body is disposed in the terminal crimping device 100 while being wound into a reel (not shown). Then, the crimp terminal 1 is crimped to the electric wire 50, and is thereafter cut off from the terminal chain body.

The terminal crimping device 100 is described.

Figure 8:
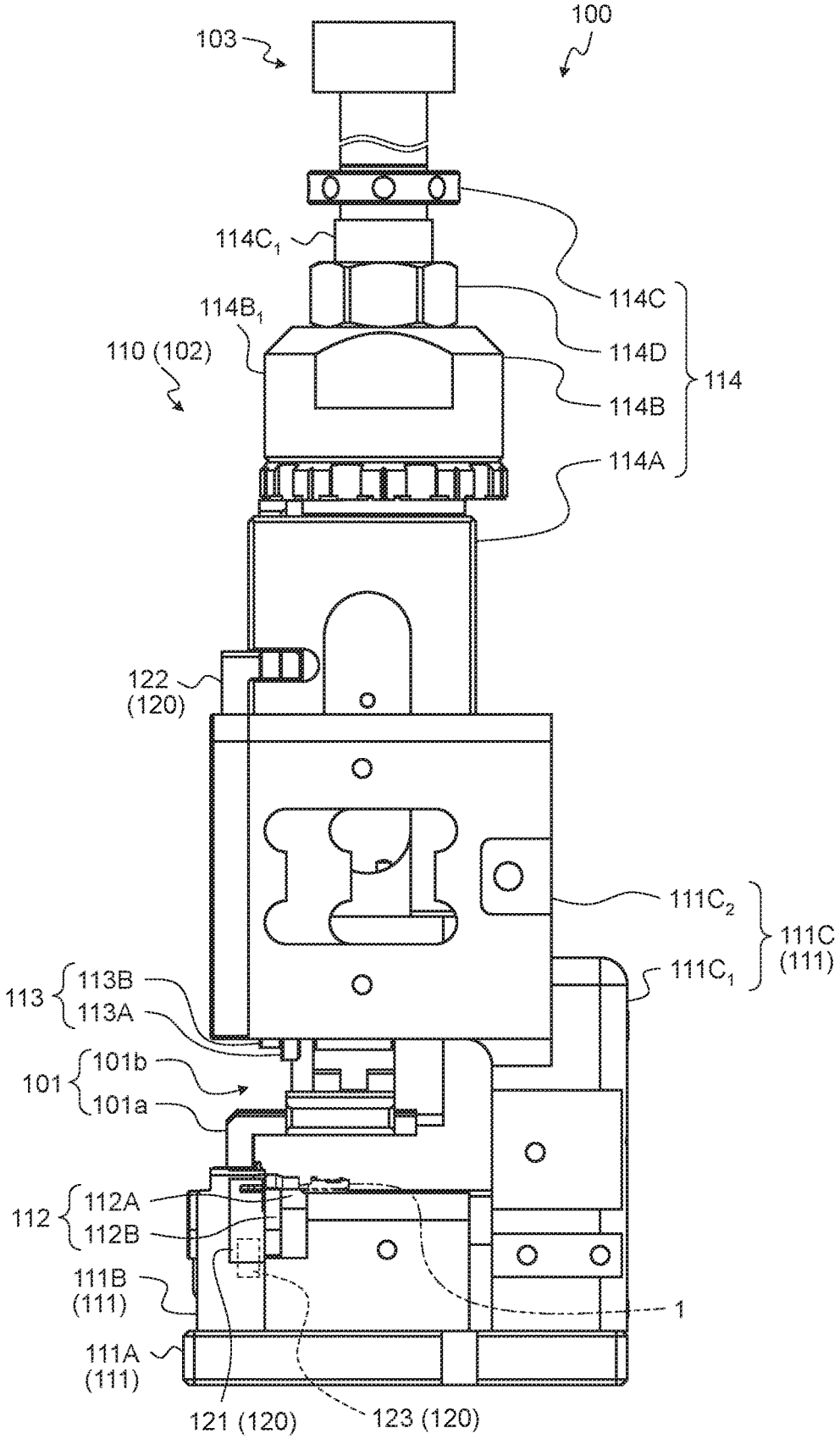
FIG. 8 is a diagram for describing a terminal crimping device.

As illustrated in FIG. 8, the terminal crimping device 100 includes a terminal supply device 101 configured to supply the crimp terminal 1 to a predetermined crimping position, a crimping device 102 configured to crimp the crimp terminal 1 to the electric wire 50 at the crimping position, and a driving device 103 configured to operate the terminal supply device 101 and the crimping device 102. The terminal supply device 101 and the crimping device 102 are devices called applicator in the technical field.

The terminal supply device 101 pulls out the first crimp terminal 1 on the outer circumferential side of the terminal chain body rolled up into a reel, and sequentially supplies the crimp terminal 1 to a crimping position. The terminal supply device 101 crimps the first crimp terminal 1 to the electric wire 50 and cuts the resultant from the terminal chain body, and then supplies the new first crimp terminal 1 to the crimping position. The terminal supply device 101 repeats this operation sequentially for every crimping process and cutting process.

The terminal supply device 101 has a well-known configuration in the technical field, and includes a terminal feed member 101*a* to be inserted into the terminal feed hole 31*a* in the coupling piece 31 and a power transfer mechanism 101*b* configured to drive the terminal feed member 101*a* with power of the driving device 103. The power transfer mechanism 101*b* is formed as a link mechanism configured to operate simultaneously with a crimping operation of the crimping device 102 (vertical movement of ram 114A and the like described later). The exemplified terminal supply device 101 operates simultaneously with the crimping operation of the crimping device 102 to drive the terminal feed member 101*a* in the vertical direction and the horizontal direction, thereby supplying the crimp terminal 1 to the crimping position.

The crimping device 102 crimps the supplied crimp terminal 1 to the electric wire 50, and cuts off the crimp terminal 1 from the terminal chain body. Thus, the crimping device 102 includes a crimping machine 110 and a terminal cutting machine 120.

The crimping machine 110 is a device configured to swage the crimp terminal 1 supplied to the crimping position to the end portion of the electric wire 50 to crimp the crimp terminal 1 to the electric wire 50. The exemplified crimping machine 110 crimps the crimp terminal 1 to the electric wire 50 by swaging the first barrel piece 15 and the second barrel piece 16 of the crimp terminal 1 to the tip core 51 and the coating 52 of the electric wire 50, respectively. The crimping machine 110 includes a frame 111, a first die 112 and a second die 113 that are paired, and a power transfer mechanism 114.

The frame 111 includes a base 111A, an anvil support 111B, and a support for the power transfer mechanism 114 (hereinafter referred to as "transfer unit support") 111C. For example, the base 111A is fixed onto a placement stage (not shown) on which the terminal crimping device 100 is to be placed. The anvil support 111B and the transfer unit support 111C are fixed onto the base 111A. The transfer unit support 111C is disposed behind (right side in FIG. 8) and above (upper side in FIG. 8) the anvil support 111B. Specifically, the transfer unit support 111C includes an upright portion 111$C_1$ that is provided upright behind the anvil support 111B and upward from the base 111A, and a ram support portion 111$C_2$ held on top of the upright portion 111$C_1$. The ram support portion 111$C_2$ is a support portion configured to support the ram 114A described later, and is disposed above the anvil support 111B with a predetermined interval.

Figure 9:
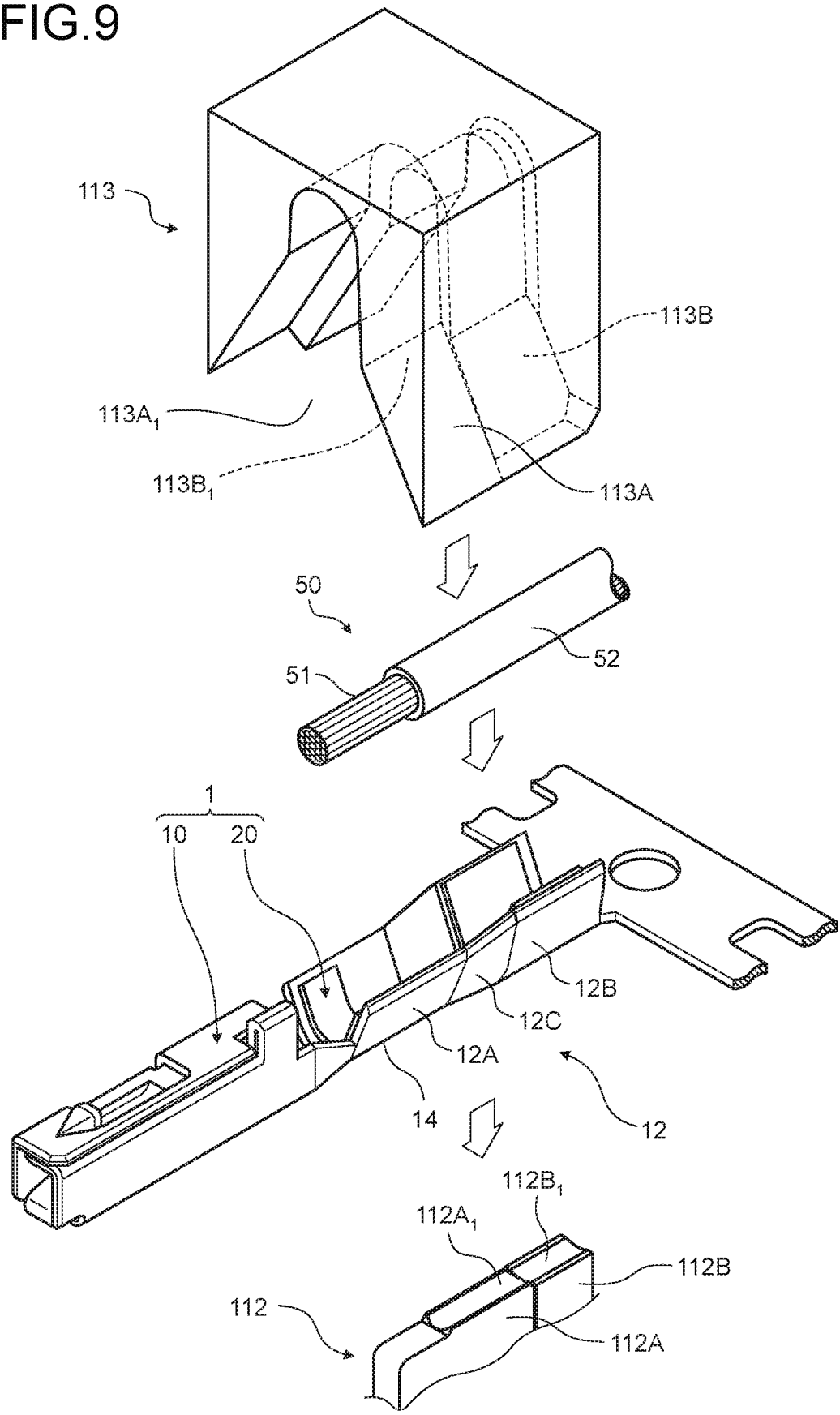
FIG. 9 is a perspective view for describing first and second dice.

The first die 112 and the second die 113 are crimping dies that are arranged with an interval in the vertical direction and configured to sandwich the crimp terminal 1 and the end portion of the electric wire 50 arranged between the first die 112 and the second die 113 to crimp the crimp terminal 1 to the end portion of the electric wire 50 (FIG. 9). The first die 112 is formed of two lower dies, and has a first anvil 112A and a second anvil 112B as the lower dies. The second die 113 is formed of two upper dies, and has a first crimper 113A and a second crimper 113B as the upper dies. The first anvil 112A and the first crimper 113A are arranged to be opposed to each other in the vertical direction, and crimp the U-shaped core crimping portion 12A to the tip core 51 by narrowing the interval between the first anvil 112A and the first crimper 113A. Furthermore, the second anvil 112B and the second crimper 113B are arranged to be opposed to each other in the vertical direction, and crimp the U-shaped coating crimping portion 12B to the coating 52 by narrowing the interval between the second anvil 112B and the second crimper 113B.

The driving device 103 transfers power thereof to the power transfer mechanism 114, thereby decreasing the interval between the first anvil 112A and the first crimper 113A and the interval between the second anvil 112B and the second crimper 113B during the crimping process and increasing the interval between the first anvil 112A and the first crimper 113A and the interval between the second anvil 112B and the second crimper 113B after the crimping process. In the present exemplification, the second die 113 is moved vertically with respect to the first die 112 such that the first crimper 113A and the second crimper 113B are simultaneously moved vertically with respect to the first anvil 112A and the second anvil 112B. Note that the first anvil 112A, the second anvil 112B, the first crimper 113A, and the second crimper 113B may be compacts that are individually formed, and in this case, the driving device 103 and the power transfer mechanism 114 may be configured to vertically move the first crimper 113A and the second crimper 113B individually. In the present exemplification, after the crimping of the core crimping portion 12A is started by the first anvil 112A and the first crimper 113A, the crimping of the coating crimping portion 12B is started by the second anvil 112B and the second crimper 113B.

The power transfer mechanism 114 in the present embodiment is configured to transfer power output from the driving device 103 to the first crimper 113A and the second crimper 113B, and includes the ram 114A, a ram bolt 114B, and a shank 114C as illustrated in FIG. 8.

The ram 114A is a movable member supported by the ram support portion 111$C_2$ so as to be freely movable vertically. The second die 113 is fixed to the ram 114A. Thus, the first crimper 113A and the second crimper 113B can move vertically with respect to the ram support portion 111$C_2$ while being integrated with the ram 114A. For example, the ram 114A is formed into a rectangular parallelepiped. A female thread portion (not shown) is formed on the ram 114A. The female thread portion is formed on an inner circumferential surface of a vertical hole formed inward of the ram 114A toward the upper end surface.

The ram bolt 114B has a male thread portion (not shown) to be threaded with the female thread portion of the ram 114A. Thus, the ram bolt 114B can move vertically with respect to the ram support portion 111$C_2$ while being integrated with the ram 114A. Furthermore, the ram bolt 114B has a bolt head 114$B_1$ disposed above the male thread portion. A female thread portion (not shown) is formed on the bolt head 114$B_1$. The female thread portion is formed on an inner circumferential surface of a vertical hole formed inward of the bolt head 114$B_1$ toward the upper end surface.

The shank 114C is a columnar hollow member, and has a male thread portion 114$C_1$ and a connection portion (not shown) at respective end portions. The male thread portion 114$C_1$ of the shank 114C is formed on the lower side of the hollow member, and is threaded with the female thread portion of the bolt head 114$B_1$ of the ram bolt 114B. Thus, the shank 114C can move vertically with respect to the ram support portion 111$C_2$ while being integrated with the ram 114A and the ram bolt 114B. The connection portion is connected to the driving device 103.

The driving device 103 includes a drive source (not shown) and a power conversion mechanism (not shown) configured to convert drive power of the drive source into power in the vertical direction. The connection portion of the shank 114C is coupled to an output shaft of the power conversion mechanism. Thus, the first crimper 113A and the second crimper 113B move vertically with respect to the ram support portion 111$C_2$ while being integrated with the ram 114A, the ram bolt 114B, and the shank 114C in response to the output of the driving device 103 (output of power conversion mechanism). As the drive source, an electric actuator such as an electric motor, a hydraulic actuator such as a hydraulic cylinder, and a pneumatic actuator such as an air cylinder are applicable.

In this case, a relative position of the first crimper 113A in the vertical direction with respect to the first anvil 112A and a relative position of the second crimper 113B in the vertical direction with respect to the second anvil 112B can be changed by adjusting a screwing amount of the female thread portion of the bolt head 114$B_1$ and the male thread portion 114$C_1$ of the shank 114C. A nut 114D is threaded with the male thread portion 114$C_1$ of the shank 114C above the ram bolt 114B, and functions as what is called a locknut together with the female thread portion of the bolt head 114$B_1$. Thus, by fastening the nut 114D to the ram bolt 114B side after the adjustment of the above-mentioned relative positions is completed, the first crimper 113A and the second crimper 113B can be fixed at the relative positions.

At respective upper distal ends of the first anvil 112A and the second anvil 112B, concave surfaces 112$A_1$ and 112$B_1$ that are recessed downward are formed (FIG. 9). The concave surfaces 112$A_1$ and 112$B_1$ are formed into arcs conforming to the shapes of the bottom 14 at the U-shaped core crimping portion 12A and the U-shaped coating crimping portion 12B, respectively. In the crimping machine 110, the concave surfaces 112$A_1$ and 112$B_1$ serve as crimping positions. In the crimp terminal 1 that has been supplied with the bottom 14 facing downward, the bottom 14 of the core crimping portion 12A is placed on the concave surface 112$A_1$ at the upper end of the first anvil 112A, and the bottom 14 of the coating crimping portion 12B is placed on the concave surface 112$B_1$ at the upper end of the second anvil 112B. The first die 112 is supported by the anvil support 111B in the state in which the concave surfaces 112$A_1$ and 112$B_1$ are exposed upward to the core crimping portion 12A and the coating crimping portion 12B.

Figure 10:
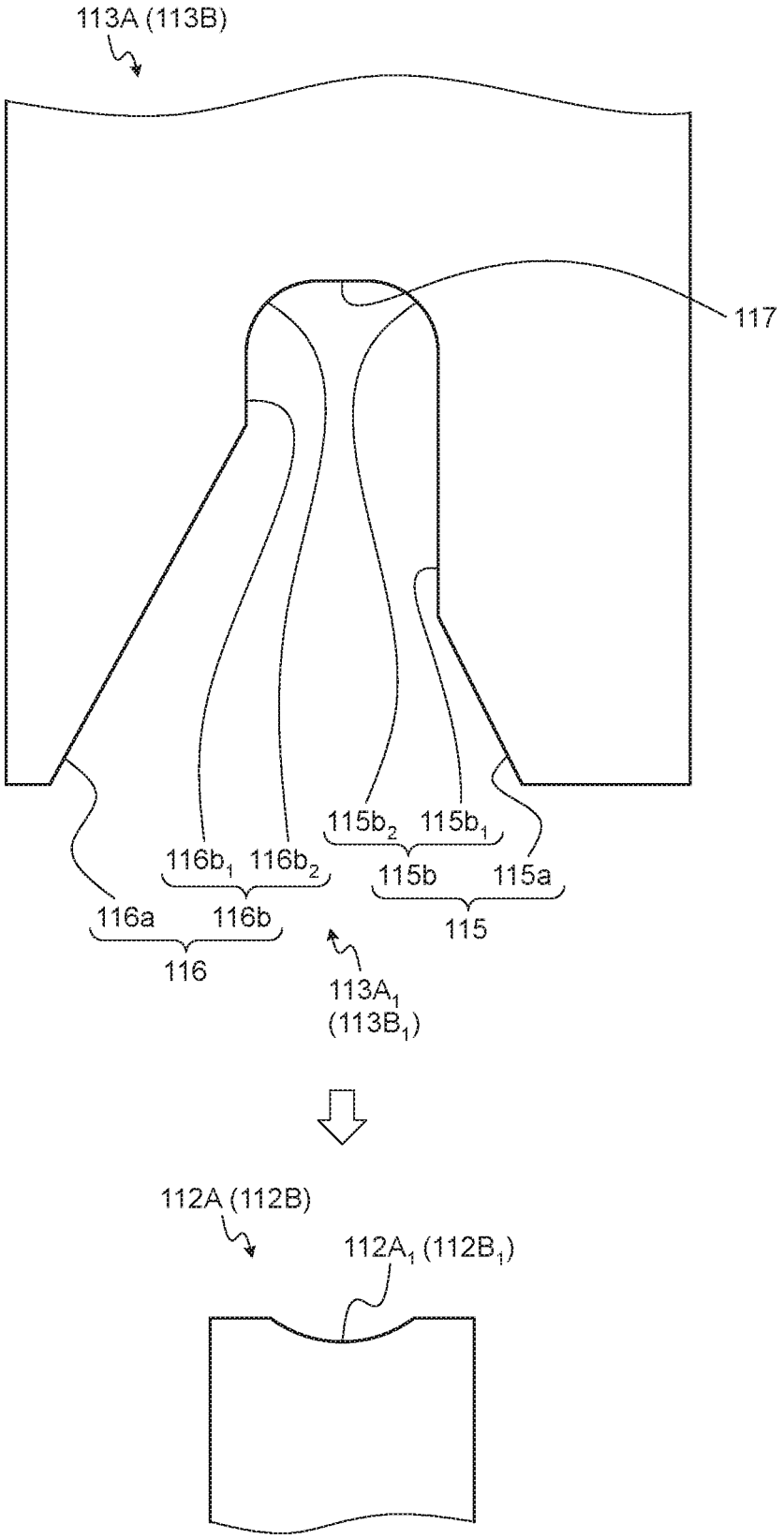
FIG. 10 is a front view for describing the first and the second dice.

In the first crimper 113A and the second crimper 113B, concave portions 113$A_1$ and 113$B_1$ that are recessed upward are formed, respectively (FIG. 9 and FIG. 10). The concave portions 113$A_1$ and 113$B_1$ are arranged to be opposed to the concave surfaces 112$A_1$ and 112$B_1$ of the first anvil 112A and the second anvil 112B, respectively, in the vertical direction. Each of the concave portions 113$A_1$ and 113$B_1$ has first and second wall surfaces 115 and 116 opposed to each other, and a third wall surface 117 that connects upper ends of the first and second wall surfaces 115 and 116. Each of the concave portions 113$A_1$ and 113$B_1$ swages the first barrel piece 15 and the second barrel piece 16 while winding the first barrel piece 15 and the second barrel piece 16 around the end portion of the electric wire 50 in a manner that the first to third wall surfaces 115, 116, and 117 are brought into contact with the first barrel piece 15 and the second barrel piece 16. The concave portions 113$A_1$ and 113$B_1$ are formed such that such a swaging operation can be performed.

The first wall surface 115, which first comes into contact with the first barrel piece 15, has a receiving portion 115*a* and a rolling portion 115*b*.

The receiving portion 115*a* is a wall surface to be first brought into contact with the first barrel piece 15, and the distal end 15*a* of the first barrel piece 15 abuts the receiving portion 115*a* along with the lowering of the second die 113. The receiving portion 115*a* is inclined so as to gradually approach the second wall surface 116 as the distance from the concave surfaces 112$A_1$ and 112$B_1$ of the first anvil 112A and the second anvil 112B increases (that is, toward the upper side). Thus, along with the lowering of the second die 113, the first barrel piece 15 is pushed sequentially from the distal end 15*a* side toward the electric wire 50 while sliding on the receiving portion 115*a*.

The rolling portion 115*b* is a wall surface for rolling the first barrel piece 15 pushed by the receiving portion 115*a* toward the end portion of the electric wire 50. The rolling portion 115*b* has a planar vertical surface 115$b_1$ that is extended upward from a boundary portion with the receiving portion 115*a*, and an arc surface 115$b_2$ that is continuous to the vertical surface 115$b_1$, for rolling the first barrel piece 15, which has been slid along the vertical surface 115$b_1$, from the distal end 15*a* side toward the end portion of the electric wire 50. The vertical surface 115$b_1$ is a flat surface along the movement direction of the second die 113. The arc surface 115$b_2$ is a surface smoothly connected to the vertical surface 115$b_1$, and is formed into an arc toward the second wall surface 116. In the present exemplification, because the third wall surface 117 is provided, the arc surface 115$b_2$ is formed so as to smoothly connect the vertical surface 115$b_1$ and the third wall surface 117 to each other. Owing to such a rolling portion 115*b*, when the first barrel piece 15 reaches the arc surface 115$b_2$ while sliding on the rolling portion 115*b* along with the lowering of the second die 113, the first barrel piece 15 is rolled toward the end portion of the electric wire 50 sequentially from the distal end 15*a* side.

The second wall surface 116, which first comes into contact with the second barrel piece 16, has a receiving portion 116*a* and a rolling portion 116*b* similarly to the first wall surface 115.

The receiving portion 116*a* is a wall surface to be first brought into contact with the second barrel piece 16, and the distal end 16*a* of the second barrel piece 16 abuts the receiving portion 116*a* along with the lowering of the second die 113. The receiving portion 116*a* is inclined so as to gradually approach the first wall surface 115 as the distance from the concave surfaces 112$A_1$ and 112$B_1$ of the first anvil 112A and the second anvil 112B increases (toward the upper side). Thus, along with the lowering of the second die 113, the second barrel piece 16 is pushed sequentially from the distal end 16*a* side toward the electric wire 50 while sliding on the receiving portion 116*a*.

The rolling portion 116*b* is a wall surface for rolling the second barrel piece 16 pushed by the receiving portion 116*a* toward the end portion of the electric wire 50. The rolling portion 116*b* has a planar vertical surface 116$b_1$ that is extended upward from a boundary portion with the receiving portion 116*a*, and an arc surface 116$b_2$ that is continuous to the vertical surface 116$b_1$, for rolling the second barrel piece 16, which has been slid along the vertical surface 116$b_1$, from the distal end 16*a* side toward the end portion of the electric wire 50. The vertical surface 116$b_1$ is a flat surface along the movement direction of the second die 113. The arc surface 116$b_2$ is a surface smoothly connected to the vertical surface 116$b_1$, and is formed into an arc toward the first wall surface 115. In the present exemplification, because the third wall surface 117 is provided, the arc surface 116$b_2$ is formed so as to smoothly connect the vertical surface 116$b_1$ and the third wall surface 117 to each other. Owing to such a rolling portion 116*b*, when the second barrel piece 16 reaches the arc surface 116$b_2$ while sliding on the rolling portion 116*b* along with the lowering of the second die 113, the second barrel piece 16 is rolled toward the end portion of the electric wire 50 sequentially from the distal end 16*a* side.

The third wall surface 117 is formed as a flat surface orthogonal to the movement direction (vertical direction) of the second die 113 or an arc surface that smoothly connects the respective arc surfaces 115$b_2$ and 116$b_2$ of the rolling portions 115*b* and 116*b*.

The second barrel piece 16 is longer than the first barrel piece 15. Thus, along with the lowering of the second die 113, the distal end 16*a* of the second barrel piece 16 moves to the third wall surface 117 while sliding on the second wall surface 116, and moves to the first wall surface 115 while sliding on the third wall surface 117. In response to the shift of the sliding-contact surface of the second barrel piece 16 on the second die 113 side, the second barrel piece 16 is wound around the first barrel piece 15 and the electric wire 50 while being rolled toward the electric wire 50. In this case, the second barrel piece 16 pushes the first barrel piece 15 toward the electric wire 50 by the inner wall surface thereof, thereby assisting the rolling of the first barrel piece 15 toward the electric wire 50. Thus, after the first barrel piece 15 is rolled toward the electric wire 50 by the arc surface 115$b_2$, the rolling is continued due to the force from the second barrel piece 16, and the first barrel piece 15 is wound around the electric wire 50.

Figure 11:
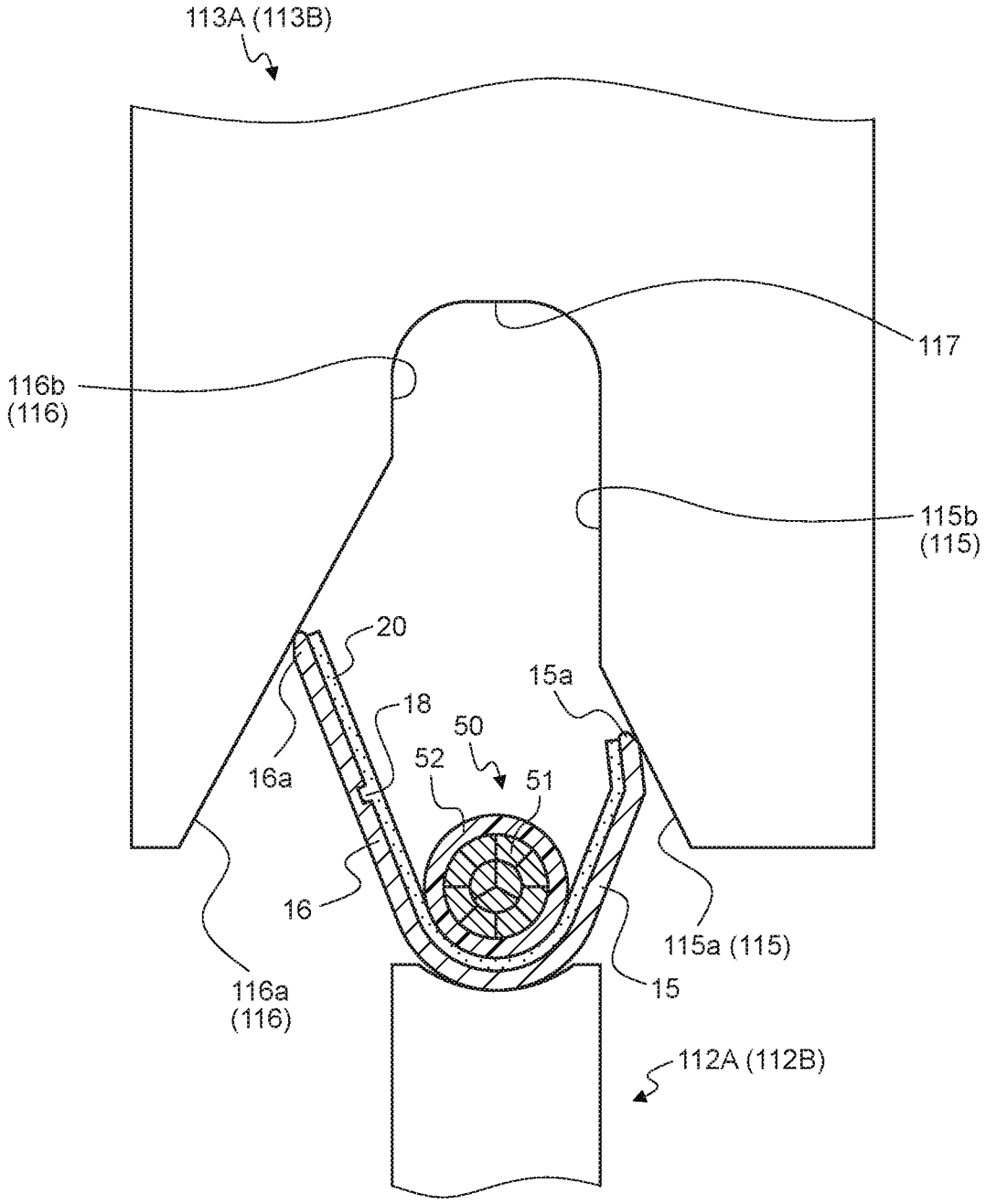
FIG. 11 is a diagram illustrating a part of a crimping process in a site cut along the line X-X in FIG. 3.
Figure 12:
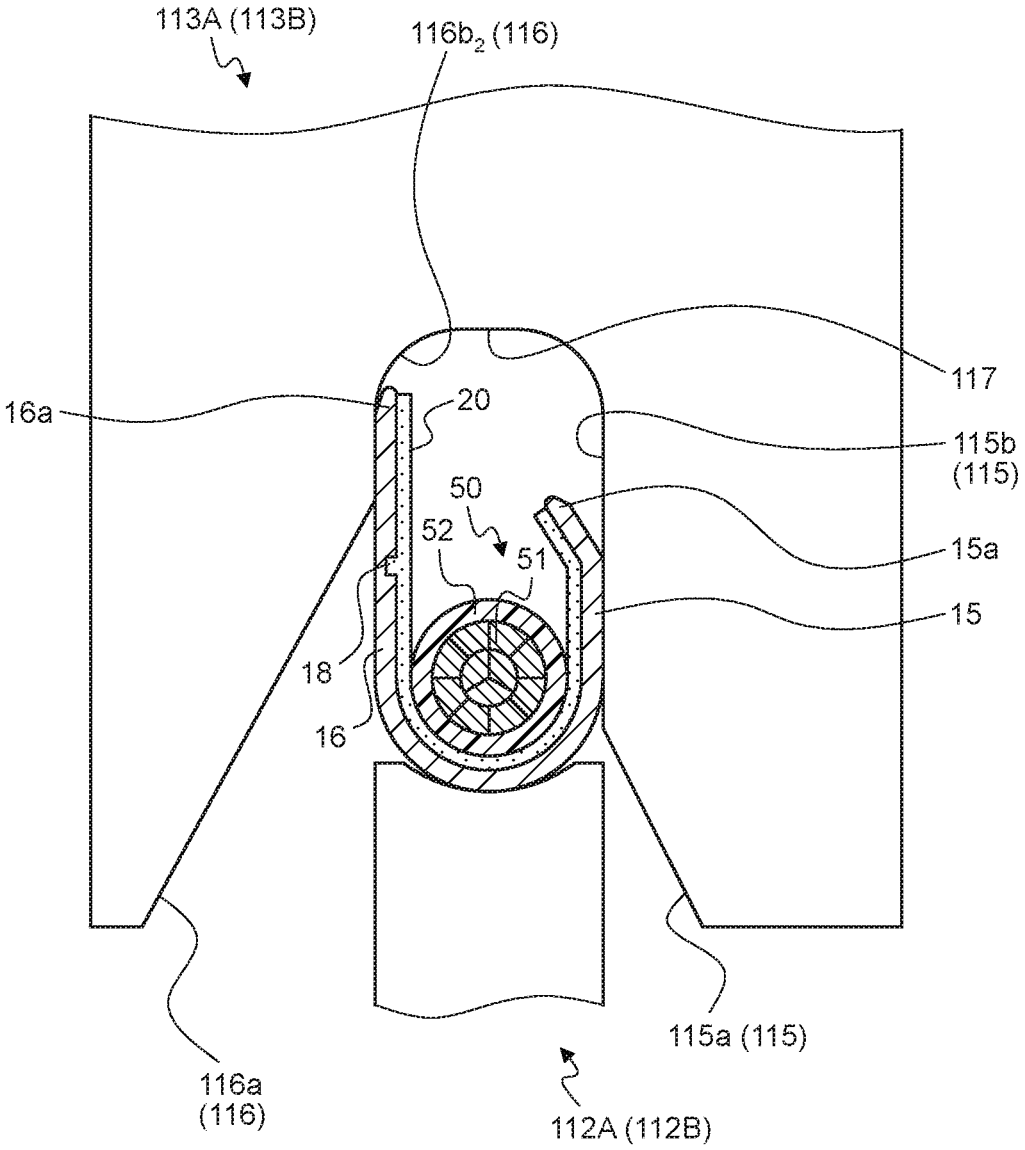
FIG. 12 is a diagram illustrating a part of the crimping process in the site cut along the line X-X in FIG. 3.

The receiving portions 115*a* and 116*a* are formed into such shapes that the first barrel piece 15 and the second barrel piece 16 abut the receiving portions 115*a* and 116*a*, respectively, at substantially the same time along with the lowering of the second die 113 (FIG. 11).

The first barrel piece 15 and the second barrel piece 16 become less easily bent as the rigidity thereof becomes higher, and hence it is difficult to roll the first barrel piece 15 and the second barrel piece 16 toward the electric wire 50 at the rolling portions 115*b* and 116*b*. For example, in the present embodiment, the second barrel piece 16 is longer than the first barrel piece 15, and hence the second barrel piece 16 reaches the arc surface 116$b_2$ of the rolling portion 116*b* earlier than the first barrel piece 15. Thus, in the electric wire connection portion 12, in the case where the second barrel piece 16 has too high rigidity to be bent at the arc surface 116$b_2$, for example, the second barrel piece 16 is not bent along with the lowering of the second die 113, and an excessive load is applied to the bottom 14, with the result that a crimping process cannot be performed in a desired crimping form for the end portion of the electric wire 50. Furthermore, in the electric wire connection portion 12 in the present embodiment, the barrel piece of the core crimping portion 12A and the barrel piece of the coating crimping portion 12B are integrated together through the coupling crimping portion 12C (that is, the first barrel piece 15 and the second barrel piece 16 are what is called an integrated barrel piece capable of rolling the tip core 51 and the coating 52 at the end portion of the electric wire 50), and hence the rigidity of the first barrel piece 15 and the second barrel piece 16 is high. Thus, in the electric wire connection portion 12, the crimping workability for the end portion of the electric wire 50 may decrease in terms of this point.

In view of the above, in the present embodiment, at least one groove portion 18 that serves as a start point of bending of the second barrel piece 16 is provided in the inner wall surface of the electric wire connection portion 12 (FIG. 4 and FIG. 5).

The groove portion 18 is provided in the second barrel piece 16 along the first direction L (in other words, axial direction of end portion of electric wire 50 to be crimped). The groove portion 18 is a low-rigidity site which is interposed between a high-rigidity site on the electric wire 50 side and a high-rigidity site on the distal end 16*a* side and has rigidity lower than that of the high-rigidity sites. In the second barrel piece 16, the rigidity of the groove portion 18 is lower than rigidity around the groove portion 18, and hence the second barrel piece 16 starts to bend at the groove portion 18 as a starting point when force is applied to the bottom 14 and the distal end 16*a* from the first die 112 and the second die 113.

The groove portion 18 is a straight groove that is extended along the first direction L between end portions of the electric wire connection portion 12 (end portion on coupling portion 13 side and end portion on connecting portion 32 side). In other words, the groove portion 18 is a straight groove that is formed along the first direction L and over the region from the tip core 51 to the coating 52 at the end portion of the electric wire 50. The groove portion 18 may be extended to reach the end surfaces of the end portions of the electric wire connection portion 12, or may be extended to positions on the inner side of the end surfaces. In the present exemplification, the latter case is taken as an example. In the case where the groove portions 18 are provided in plurality, the groove portions 18 are arranged in parallel with intervals therebetween in the inner wall surface of the electric wire connection portion 12. In the present exemplification, a single groove portion 18 is formed in the inner wall surface of the electric wire connection portion 12 and in the second barrel piece 16.

For example, the groove portion 18 may be a U-shaped groove obtained by hollowing out the cross section orthogonal to the extending direction of the groove portion 18 into a rectangular shape, or may be a V-shaped groove like a notch obtained by being hollowed out into a triangular shape. The groove width (in case of U-shaped groove) or an included angle of the V-shape (in case of V-shaped groove) and the groove depth of the groove portion 18 are set to such sizes that the groove portion 18 serves as a starting point of bending of the second barrel piece 16 due to force applied from the first die 112 and the second die 113 and that the second barrel piece 16 is not divided across the groove portion 18. Furthermore, the groove portion 18 includes a portion whose plate thickness is smaller than that of the surrounding (high rigidity site on electric wire 50 side and high rigidity site on distal end 16*a* side).

For winding the second barrel piece 16 around the electric wire 50, it is desired to bend the second barrel piece 16 on the distal end 16*a* side with respect to the electric wire 50 placed on the bottom 14. Thus, the groove portion 18 is provided on the distal end 16*a* side with respect to the end portion of the electric wire 50 placed on the bottom 14 (FIG.

Figure 14:
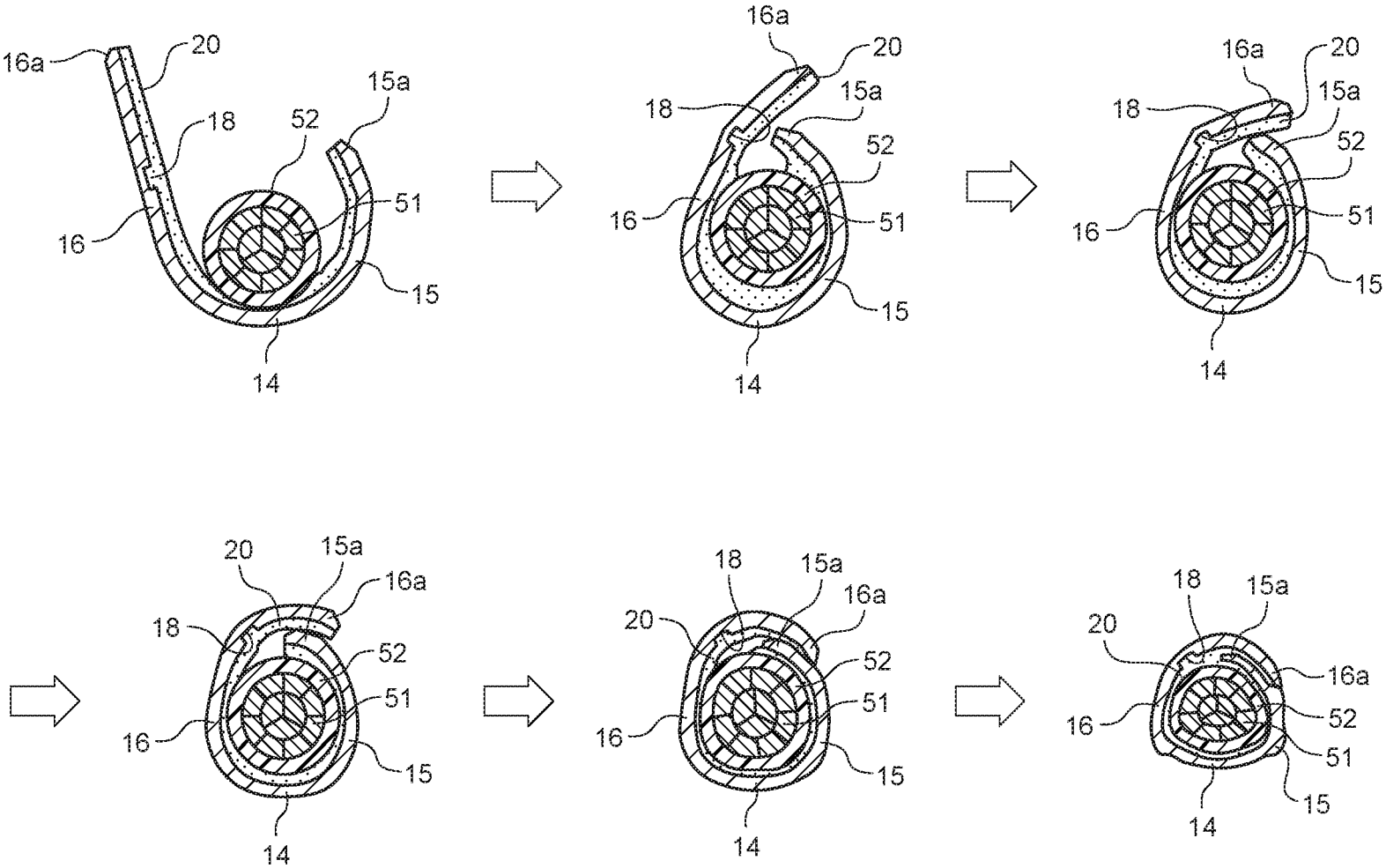
FIG. 14 is a diagram illustrating the crimping process in the site cut along the line X-X in FIG. 3.

11 to FIG. 14). On the other hand, if the groove portion 18 is too close to the distal end 16*a* in the region on the distal end 16*a* side with respect to the electric wire 50, the region of the high rigidity site on the electric wire 50 side is enlarged, and the groove portion 18 may be less likely to serve as a starting point of bending. Thus, in the case where the single groove portion 18 is provided, it is desired to provide the groove portion 18 at a center portion between the electric wire 50 and the distal end 16*a* in the region on the distal end 16*a* with respect to the electric wire 50 in the second barrel piece 16. Then, in the case where a crimping process is not still performed in a desired crimping form for the end portion of the electric wire 50, a plurality of the groove portions 18 only need to be provided in the region on the distal end 16*a* side with respect to the electric wire 50 in the second barrel piece 16. In addition, it is desired to provide the groove portion 18 at a position at which the distal end 15*a* of the first barrel piece 15 is not hooked during the crimping process in order to secure a desired crimping form.

Figure 13:
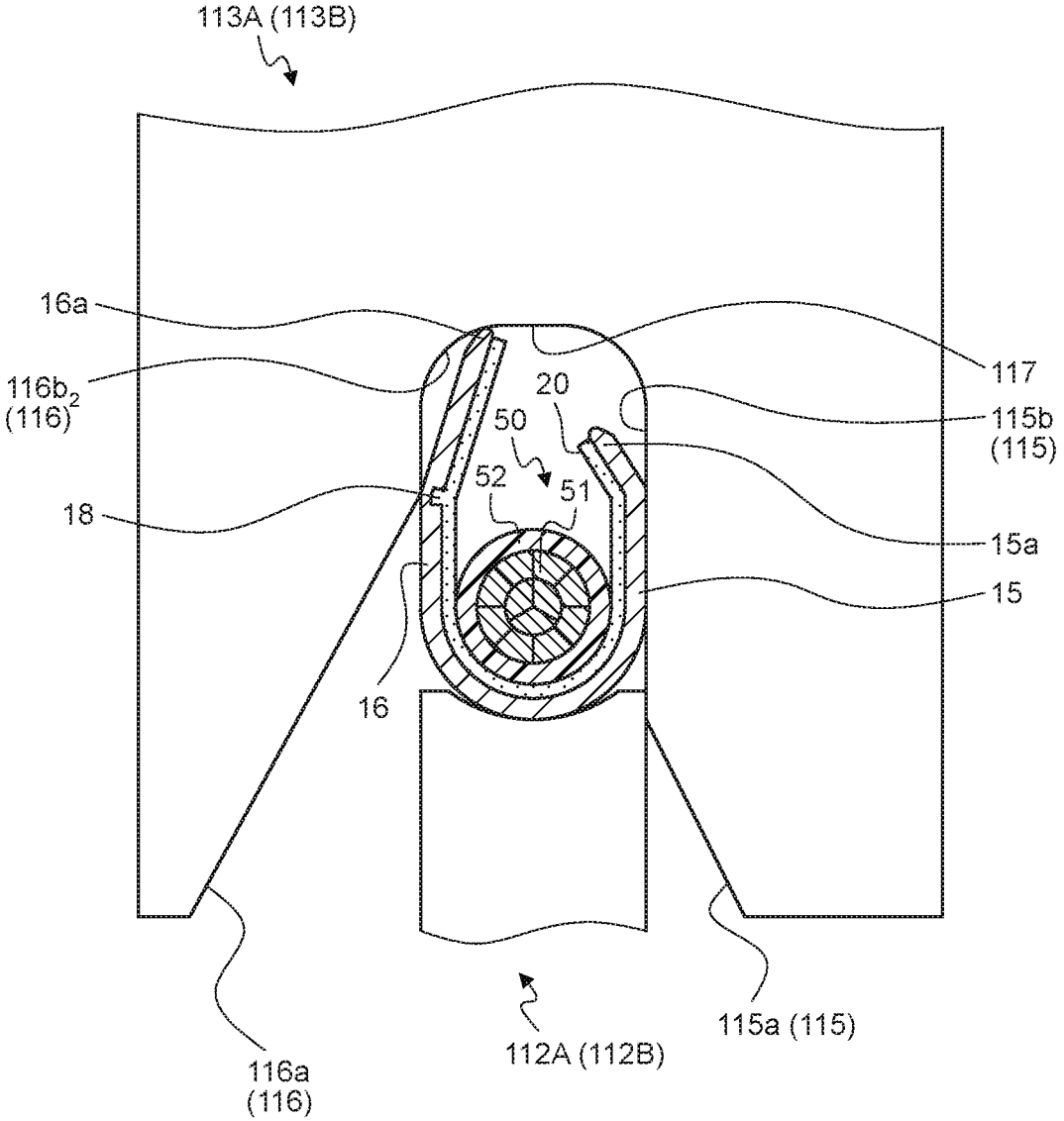
FIG. 13 is a diagram illustrating a part of the crimping process in the site cut along the line X-X in FIG. 3.

For example, in the electric wire connection portion 12, the distal end 16*a* of the second barrel piece 16 reaches the arc surface $116b_2$ of the rolling portion 116*b* along with the lowering of the second die 113 (FIG. 12), and the second barrel piece 16 starts to bend at the groove portion 18 as a starting point along with further lowering of the second die 113 (FIG. 13). Thus, in the electric wire connection portion 12, the first barrel piece 15 and the second barrel piece 16 can be wound around the end portion of the electric wire 50 by the crimping process using the first die 112 and the second die 113. In FIG. 14, the process of crimping to the electric wire 50 is illustrated by steps, taking the coating crimping portion 12B as an example.

The crimp terminal 1 subjected to the crimping process by the crimping machine 110 as described above is cut off from the coupling piece 31 by the terminal cutting machine 120. The terminal cutting machine 120 is configured to cut the connecting portion 32 of the crimp terminal 1 supplied to the crimping position by sandwiching the connecting portion 32 with two terminal cutting portions, and performs the cutting simultaneously with the crimping step in progress. The terminal cutting machine 120 is disposed on the front side of the second anvil 112B (left side in FIG. 8).

The terminal cutting machine 120 is well known in the technical field, and includes, for example, a terminal cutting body 121, a pressing member 122, and an elastic member 123. The terminal cutting body 121 is disposed so as to be slidable in the vertical direction along the front surface of the second anvil 112B. In the terminal cutting machine 120, a terminal cutting portion is formed on each of the terminal cutting body 121 and the second anvil 112B. The pressing member 122 is fixed to the ram 114A, and moves vertically together with the ram 114A. The pressing member 122 is disposed above the terminal cutting body 121, and lowers to push the terminal cutting body 121 downward. The elastic member 123 is configured to apply an upward biasing force to the terminal cutting body 121, and is made of a spring member or the like. When a pushing force from the pressing member 122 is released, the elastic member 123 returns the terminal cutting body 121 to its initial position in the vertical direction. In the terminal cutting machine 120, the pressing member 122 lowers along with the lowering of the second die 113 during the crimping process to push the terminal cutting body 121 downward, thereby cutting the connecting portion 32 at the corresponding terminal cutting portion and cutting off the crimp terminal 1 from the terminal chain body 30.

As described above, in the crimp terminal 1 in the present embodiment, at least one of the first barrel piece 15 and the second barrel piece 16 is provided with at least one groove portion 18 that is formed along the first direction L (axial direction of end portion of electric wire 50 to be crimped). Thus, in the crimp terminal, the first barrel piece 15 or the second barrel piece 16 having the groove portion 18 can be easily bent in the crimping process by the first die 112 and the second die 113, and hence the first barrel piece 15 and the second barrel piece 16 can be wound around the end portion of the electric wire 50 without applying an excessive load to the electric wire connection portion 12. Consequently, the crimp terminal enables the crimping process in a desired crimping form for the end portion of the electric wire 50, thus improving crimping workability.

In this case, in the electric wire connection portion 12 in the present embodiment, even the first barrel piece 15 may be hard to be bend due to its high rigidity. It is thus desired that in the electric wire connection portion 12 in this case, at least one groove portion 18 similar to that in the second barrel piece 16 be provided in the first barrel piece 15. Furthermore, in the electric wire connection portion 12 in the present embodiment, the second barrel piece 16 is longer than the first barrel piece 15, but in the case where the first barrel piece 15 and the second barrel piece 16 have equal lengths and have such high rigidity that makes it difficult for the first barrel piece 15 and the second barrel piece 16 to be bent in the crimping process using the first die 112 and the second die 113, it is desired to provide at least one groove portion 18 described above in each of the first barrel piece 15 and the second barrel piece 16. Furthermore, the place where at least one groove portion 18 is provided is not limited to the first barrel piece 15 or the second barrel piece 16 in which the core 51 side and the coating 52 side are integrated as in the present embodiment. At least one groove portion 18 may be provided to the barrel piece of the core crimping portion 12A and the barrel piece of the coating crimping portion 12B, which are formed separately.

Note that the groove portion 18 is provided on the inner wall surface side of the electric wire connection portion 12, but may be provided on the outer wall surface side of the electric wire connection portion 12.

Furthermore, the above-mentioned water stop member 20 may be overlaid on and attached to at least the groove portion 18 before a crimping process is performed. In the exemplified water stop member 20, the first water stop portion 21 is overlaid on and attached to the groove portion 18 (FIG. 7). It is desired that a part of the first water stop portion 21 be filled in the groove portion 18 by the crimping process and left therein, and the water stop member 20 be stayed inside and around the groove portion 18 even after the crimping process. Thus, for example, when the water stop member 20 is attached to the electric wire connection portion 12, a pressure toward the electric wire connection portion 12 is applied to the water stop member 20. In the present embodiment, the pressure is set to a magnitude that can push a part of the first water stop portion 21 into the groove portion 18, and the groove width of the groove portion 18 is set to a size that allows a part of the first water stop portion 21 to enter the groove portion 18 due to the pressure. Consequently, after the completion of crimping, the water stop member 20 can be stayed at least inside the groove portion 18, and the entry of water into the electric wire connection portion 12 from the groove portion 18 can be suppressed. Consequently, the crimp terminal 1 in the present embodiment can enhance the water stop performance by the water stop member 20 along with improvement of crimping workability by the groove portion 18, and in addition, can further improve the water stop performance by the water stop member 20 filled in the groove portion 18.

In the crimp terminal according to the present embodiments, the integrated first barrel piece or second barrel piece having the groove portion can be easily bent in a crimping process, and hence the first barrel piece and the second barrel piece can be wound around the end portion of the electric wire without applying an excessive load to the electric wire connection portion. Consequently, the crimp terminal enables the crimping process for the end portion of the electric wire in a desired crimping form, thus improving crimping workability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal, comprising:

a terminal connection portion configured to electrically connect to a counterpart terminal; and a plate-shaped electric wire connection portion configured to electrically connect to an end portion of an electric wire placed on an inner wall surface side thereof, by a crimping process during which the electric wire connection portion is sandwiched between a first die and a second die, wherein the electric wire connection portion comprises:

a bottom on which the end portion of the electric wire is placed in the crimping process, first and second barrel pieces that extend from both ends of the bottom in an extending direction, respectively, and are rolled along a region from a tip core of the electric wire to a coating on the end portion of the electric wire, by the crimping process, a serration region formed on inner surfaces of the bottom and the first and second barrel pieces, a water stop member formed by a uniform sheet of material disposed on inner surfaces of the bottom and the first and second barrel pieces, wherein the water stop member extends over only a portion of the serration region, wherein in the electric wire connection portion, the second barrel piece extends to be longer than the first barrel piece such that the first barrel piece is wound around the end portion of the electric wire on an inner side, the second barrel piece is wound on an outer side to cover the end portion of the electric wire and the first barrel piece from an outer circumferential surface side, and an overlap region is formed, the overlap region being a region in which an outer wall surface of the first barrel piece and an inner wall surface of the second barrel piece are opposed to each other, wherein the second barrel piece has at least one straight groove portion which serves as a starting point of bending for the crimping process, and which is formed along a longitudinal direction of the crimp terminal, wherein the at least one straight groove portion is a low-rigidity site which is interposed between a high-rigidity site on an electric wire side and a high-rigidity site on a distal end side in the extending direction and has a rigidity lower than a rigidity of the high rigidity sites, wherein the groove portion is provided closer to the distal end side in the extending direction than is the end portion of the electric wire which is both placed on the bottom and is also provided closer to a side of the bottom than is the overlap region, and wherein the water stop member is disposed over at least the at least one straight groove portion in the inner wall surface of the electric wire connection portion before the crimping process is performed, and is filled in the at least one straight groove portion by the crimping process and left therein, so as to suppress entry of water into the electric wire connection portion after the crimping process is completed.

2. The crimp terminal according to claim 1, wherein the water stop member comprises a sheet of pressure-sensitive adhesive.

3. A crimp terminal, comprising:

a terminal connection portion configured to electrically connect to a counterpart terminal; and an electric wire connection portion configured to electrically connect to an end portion of an electric wire placed on an inner wall surface side thereof, wherein the electric wire connection portion comprises:

a bottom configured to receive the end portion of the electric wire, first and second barrel pieces that extend from both ends of the bottom in an extending direction, respectively, a serration region formed on inner surfaces of the bottom and the first and second barrel pieces, a water stop member formed by a uniform sheet of material disposed on inner surfaces of the bottom and the first and second barrel pieces, wherein the water stop member extends over only a portion of the serration region, wherein in the electric wire connection portion, the second barrel piece extends to be longer than the first barrel piece such that the first barrel piece is wound around the end portion of the electric wire on an inner side, the second barrel piece is wound on an outer side to cover the end portion of the electric wire and the first barrel piece from an outer circumferential surface side, and an overlap region is formed, the overlap region being a region in which an outer wall surface of the first barrel piece and an inner wall surface of the second barrel piece are opposed to each other, wherein the second barrel piece has at least one straight groove portion which serves as a starting point of bending for a crimping process and which is formed along a longitudinal direction of the crimp terminal, wherein the first and second barrel pieces are configured to wrap around the electric wire as a result of the crimping process, and wherein the at least one straight groove portion is a low-rigidity site which is interposed between a high-rigidity site on an electric wire side and a high-rigidity site on a distal end side in the extending direction and has a rigidity lower than a rigidity of the high rigidity sites, wherein the groove portion is provided closer to the distal end side in the extending direction than is the end portion of the electric wire which is both placed on the bottom and is also provided closer to a side of the bottom than is the overlap region, and wherein the water stop member is disposed over at least the at least one straight groove portion and is filled in the at least one straight groove portion.

* * * * *